US005265932A

United States Patent [19]

Leonard

[11] Patent Number: 5,265,932

[45] Date of Patent: Nov. 30, 1993

[54] MUSICAL BABY CARRIER WITH FOOT OPERATED ROCKER

[76] Inventor: Charles Leonard, 7894 Adrian Dr., Fayetteville, N.C. 28314

[21] Appl. No.: 901,992

[22] Filed: Jun. 19, 1992

[51] Int. Cl.[5] ..... A47D 13/02; A47D 13/10

[52] U.S. Cl. ..... 297/131; 5/655; 5/904; 297/272

[58] Field of Search ..... 5/101, 105-108, 5/904, 655; 297/258, 272, 131, 270

[56] References Cited

U.S. PATENT DOCUMENTS

| | | | |
|---|---|---|---|
| 865,829 | 9/1907 | Unger | 5/101 |
| 3,292,611 | 12/1966 | Belkin | 5/101 |
| 3,376,585 | 4/1968 | Muzaurieta | 5/904 |
| 3,804,459 | 4/1974 | Nose | 297/258 |
| 4,371,206 | 2/1983 | Johnson, Jr. | 5/101 |
| 4,688,850 | 8/1987 | Brownlie et al. | 297/270 |

*Primary Examiner*—Alexander Grosz

[57] ABSTRACT

An improved baby carrier with the capabilities of playing music and rocking with the use of a foot pedal. Under the base of the carrier in a recess there are a plurality of elongated retractable rocker means pivotally attached to the underside of the carrier, a first elongated extender means pivotally connected to the recess, a second elongated extender means pivotally connected to the retractable rocker means, said first and second extender means being pivotally connected to each other and adapted to be secured in a first locked configuration relative to each other, thereby positioning the rocker means in an extended functional position outside the recess, said first and second extender means adapted to be positioned in a second collapsed configuration relative to each other, thereby positioning the rocker means in a retracted position within the recess. The music box winds up and is located near the top of the carrier. The foot pedal is disposed near the front of the carrier.

2 Claims, 2 Drawing Sheets figure 2
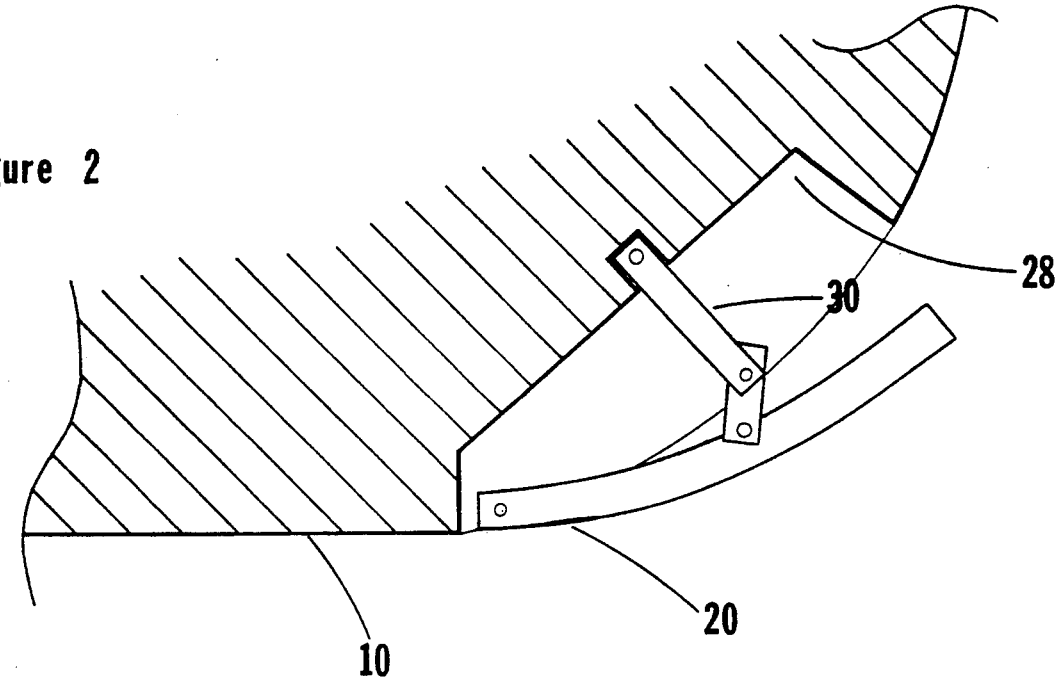
figure 3
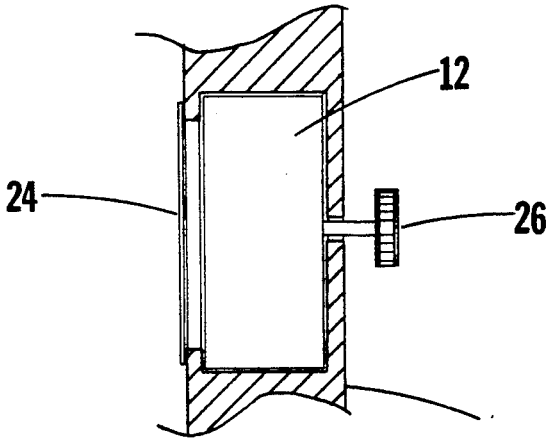
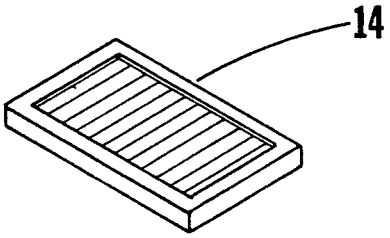
figure 4

MUSICAL BABY CARRIER WITH FOOT OPERATED ROCKER

BACKGROUND

1. Field of Invention

This invention relates to baby carriers, specifically to an improved child soothing device for baby carriers.

2. Description of Prior Art

Various types of baby carriers and seats are available on the market at the present time. Many baby carriers provide only a rocking means by way of a curved base. A curved base lends itself to the constant rocking motion when the parent may want the seat to remain stationary at times. Many baby carriers are also provided with shading devices for protection against the sun, while some baby carriers are solely for the purpose of transporting a child from place to place. Though all of these devices, separately, provide amenities to the basic baby carrier, parents have been limited to only a few combinations of the aforementioned devices. Not to mention that entertaining a child requires additional devices not directly associated with baby carriers.

OBJECTS AND ADVANTAGES

Accordingly, several objects and advantages of the present invention are:

(a) to provide a carrier which soothes and entertains a baby allowing hands-free operation;

(b) to provide a set of rockers which can be retracted into the base of the seat when not in use to provide stability;

(c) to provide a wind-up music box which plays a lullaby for a child to listen to; and (d) to provide a foot pedal built into the side of the baby carrier to rock the seat.

Further objects and advantages will become apparent from a consideration of the following description and drawings.

DRAWING FIGURES

FIG. 2 shows a side section of the carrier with the rockers in the rocking position. FIG. 3 shows a section of the positioning of the music box inside the side of the seat.

FIG. 4 shows an exploded view of the foot pedal.

REFERENCE NUMERALS IN DRAWINGS

Figure 1:
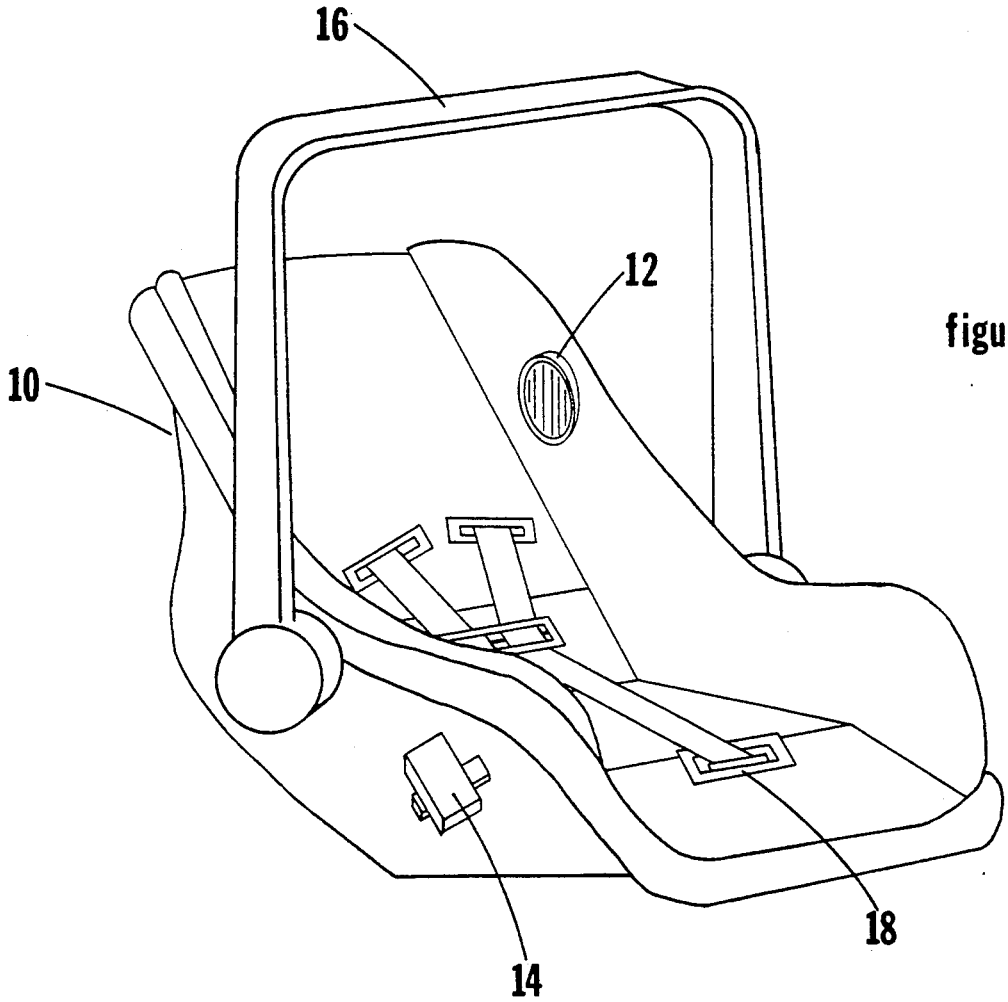
FIG. 1 shows a perspective of a baby carrier with the music box, the foot pedal, and the rockers in the retracted position.

| | |
|---|---|
| 10 baby carrier | 12 music box |
| 14 foot pedal | 16 carrying handle |
| 18 harness straps | 20 rockers |
| 24 cover | 26 wind-up knob |
| 28 rocker recess space | 30 rocker extenders |

DESCRIPTION

FIG. 1

The preferred embodiment of the baby carrier of the present invention is illustrated in FIG. 1. The baby carrier is, generally, referred to by the numeral 10.

A conventional baby carrier 10 is disclosed having a hard rubber foot pedal 14 attached to a side of the baby carrier 10 and a small music box 12 disposed near the upper portion of the baby carrier 10. On the underside of the baby carrier 10 is disposed the retractable rockers 20 (shown in FIG. 2). In FIG. 1, the rockers 20 are in their retracted position.

Other typical features included on the conventional baby carrier 10 of the present invention are a carrying handle 16, harness straps 18, and seat belt holes (not shown).

OPERATION

FIGS. 2 to 4

The manner of using the musical baby carrier with foot operated pedal is generally related to baby carriers in present use, in that, a baby is placed in the baby carrier 10 and secured in place by the harness straps 18 (and then the car seat belt is looped through the seat belt holes if riding in a vehicle).

The baby carrier 10 of the present invention can play music by twisting the small wind-up knob 26 at the side of the baby carrier 10 (FIG. 3). Music begins to play and entertains the child. The music box 12 is disposed near the top of the baby carrier 10 built into the side wall portion close to the ears of the baby in the baby carrier 10. A covering 24 made of a hard plastic for the music box 12 is also provided.

The retractable rockers 20 are shown in FIG. 2. A recess 28 to accommodate the rockers 20 in the retracted position is disposed on the underside of the baby carrier 10. The rockers 20 are connected to extenders 30 comprised of a first elongated extender means pivotally connected to the recess (28), a second elongated extender means pivotally connected to the retractable rocker (20), said first and second extender means being pivotally connected to each other and adapted to be secured in a first locked configuration relative to each other, thereby positioning the rocker means in an extended functional position outside the recess, said first and second extender means adapted to be positioned in a second collapsed configuration relative to each other, thereby positioning the rocker means in a retracted position within the recess. With the extenders 30 locked the baby carrier 10 can be rocked without collapsing to the retracted position.

With the rockers 20 extended, the baby carrier 10 can be rocked easily by placing the foot on the foot pedal 14 and pushing (FIG. 4). The child in the baby carrier 10 of the present invention can be rocked and entertained easily.

The baby carrier 10 can be injection molded of high impact plastic in an assortment of attractive colors. The seat portion can be fitted with a contoured, foam rubber cushion insert and covered with vinyl material. The rockers 20 and the extenders 30 can also be injection molded. The foot pedal can be into the design of the baby carrier 10 on either side.

SCOPE

Although the description above contains specificities, these should not be construed as limiting the scope of the invention but as merely providing illustrations of some presently preferred embodiments of this invention.

Thus the scope of the invention should be determined by the appended claims and their legal equivalents, rather than by the examples given.

I claim:

1. A child carrier usable as a rocker and music playing device, the carrier comprising a frame; a music playing means built into the frame of said carrier, a recess disposed on the underside of said carrier, a plurality of elongated retractable rocker means pivotally attached to the underside of said carrier, a first elongated extender means pivotally connected to the recess, a second elongated extender means pivotally connected to the retractable rocker means, said first and second extender means being pivotally connected to each other and adapted to be secured in a first locked configuration relative to each other, thereby positioning the rocker means in an extended functional position outside the recess, said first and second extender means adapted to be positioned in a second collapsed configuration relative to each other, thereby positioning the rocker means in a retracted position within the recess; and pedal means for rocking said carrier when said rocker means are extended from said recess, said pedal means being disposed on a side of said carrier near the front of said carrier.

2. The carrier of claim 1; wherein the music playing means comprises a wind up means for activating said music playing means positioned on the outer portion of the frame, and a covering means positioned on an inner portion of the frame.

* * * * *